US007096704B2

(12) United States Patent
Asano

(10) Patent No.: US 7,096,704 B2
(45) Date of Patent: Aug. 29, 2006

(54) STRUCTURAL BODY AND METHOD FOR COLD ROLLING

(75) Inventor: Tsuyoshi Asano, Himeji (JP)

(73) Assignee: Haruna Co., Ltd., (JP)

( * ) Notice: Subject to any disclaimer, the term of this patent is extended or adjusted under 35 U.S.C. 154(b) by 136 days.

(21) Appl. No.: 10/480,393

(22) PCT Filed: Jul. 17, 2002

(86) PCT No.: PCT/JP02/07273

§ 371 (c)(1),
(2), (4) Date: Jan. 26, 2004

(87) PCT Pub. No.: WO03/008121

PCT Pub. Date: Jan. 30, 2003

(65) Prior Publication Data

US 2004/0112105 A1 Jun. 17, 2004

(30) Foreign Application Priority Data

Jul. 17, 2001 (JP) ..... 2001-249628

(51) Int. Cl.
*B21B 39/08* (2006.01)

(52) U.S. Cl. ..... 72/205; 72/227; 72/234

(58) Field of Classification Search ..... 72/160, 72/164, 177, 181, 199, 203–206, 224–227, 72/234, 250

See application file for complete search history.

(56) References Cited

U.S. PATENT DOCUMENTS 1,424,465 A * 8/1922 Gail ..... 72/11.5
3,269,007 A * 8/1966 O'Donnell ..... 72/178

FOREIGN PATENT DOCUMENTS

| | | |
|---|---|---|
| JP | 58-187203 | 11/1983 |
| JP | 60-166103 | 8/1985 |
| JP | 2-099203 | 4/1990 |
| JP | 5-069032 | 3/1993 |
| JP | 9-108707 | 4/1997 |
| JP | 9-314235 | 12/1997 |

* cited by examiner

*Primary Examiner*—Jack Keith
*Assistant Examiner*—Hung C. Le
(74) *Attorney, Agent, or Firm*—Cook, Alex, McFarron, Manzo, Cummings & Mehler, Ltd,

(57) ABSTRACT

A cold rolling method for performing a series of processes including rolling and cutting of a workpiece in succession, wherein tensile forces are applied to the workpiece during processes from the rolling to straightening.

To eliminate the processes of annealing, pickling and chemical conversion coating to accomplish cost reduction and energy saving. To reduce material loss to 5% or lower. To decrease dimensional variation among workpieces (within 0.05 mm or lower) and improve straightness of the rolled workpiece including end parts thereof after cutting (final precision of 0.1 mm). To decrease lead time necessary to process a base material before it is introduced into the rolling line to reduce running and equipment costs.

10 Claims, 2 Drawing Sheets

STRUCTURAL BODY AND METHOD FOR COLD ROLLING

BACKGROUND OF THE INVENTION

1. Field of the Invention

The present invention relates to a cold rolling system having a tandem structure comprising a plurality of rolling mills each having a powered turks-head roll having driving rolls vertically disposed and free rolls laterally disposed and a non-powered turks-head roll. The present invention also relates to a cold rolling method using the above system.

2. Description of the Background Art

Cold drawing has been employed as means for forming a rail or the like which is uniform in the longitudinal direction thereof. Cold drawing requires a base material having a relatively large cross-sectional area to obtain a desired deformed shape. This increases the total processing rate and often causes a rapture of a material due to insufficient strength thereof or an unstable pressure exerted on that part of the material to be deformed, or cracking or abnormal wear of a die due to insufficient strength thereof. Thus, process annealing is necessary to obtain a desired final shape. Also, in order to prevent wear and seizure of a drawing die due to high sliding friction created by a high bearing pressure between the base material and the die, a chemical solid lubricating coating such as a zinc stearate coating must be provided on surfaces of the base material. This requires a pickling process and a chemical conversion coating process, which may adversely affect the environment. Additionally, the conventional method includes the processes of annealing, pickling and chemical conversion coating and thus needs long lead time, increasing running and equipment costs. Moreover, in conventional drawing, a bar material is usually used, so that the material loss due to the disposal of pointed parts amounts to 10 to 30%. Also, a bar material tends to have a bend at end parts thereof and it takes time to straighten or adjust the bends.

The present invention has been made in view of the drawbacks of the prior arts and it is, therefore, an object of the present invention to provide a cold rolling system and a cold rolling method which can prevent a rapture of a workpiece due to plastic deformation under triaxial compression, which is a feature of cold rolling. The present invention also provides a cold rolling system and a cold rolling method which utilizes mutual sliding between rolls of a very small diameter and a workpiece to eliminate the processes of annealing, pickling and chemical conversion coating and accomplish cost reduction and energy saving. Another object of the present invention to provide a cold rolling system and a cold rolling method which can reduce material loss to 5% or lower and which can decrease dimensional variation among rolled workpieces (within 0.05 mm or lower) and improve straightness of a rolled workpiece including end parts thereof after cutting (final precision of 0.1 mm). Yet another object of the present invention is to provide a cold rolling system and a cold rolling method which can reduce lead time necessary to process a base material before it is introduced into the rolling line and thus can reduce the running and equipment costs.

SUMMARY OF THE INVENTION

A cold rolling system according to the invention comprises a first rolling mill providing a first rolling reduction and comprising first non-powered turks-head rolls and first powered turks-head rolls; a second rolling mill providing a second rolling reduction which is larger than said first rolling reduction, and comprising second non-powered turks-head rolls and second powered turks-head rolls, said second rolling mill being disposed opposite said first rolling mill; means for applying a first tensile force to that part of a workpiece which passes through said first rolling mill; means for applying a first tensile force to that part of said workpiece which passes through said second rolling mill; means for applying a second tensile force to that part of said workpiece which has passed through said first rolling mill and which is to be fed to said second rolling mill; and means for applying a third tensile force to that part of said workpiece which has passed through said second rolling mill.

A cold rolling system according to the invention comprises a first rolling mill providing a first rolling reduction and comprising first non-powered turks-head rolls and first powered turks-head rolls; a second rolling mill providing a second rolling reduction which is larger than said first rolling reduction, and comprising second non-powered turks-head rolls and second powered turks-head rolls, said second rolling mill being disposed opposite said first rolling mill; means for applying a first tensile force to that part of a workpiece which passes through said first rolling mill; means for applying a first tensile force to that part of a workpiece which passes through said second rolling mill; means for applying a second tensile force to that part of said workpiece which has passed through said first rolling mill and which is to be fed to said second rolling mill; means for applying a third tensile force to that part of said workpiece which has passed through said second rolling mill; a first straightening device disposed upstream of said first rolling mill for straightening said workpiece; means for applying fourth tensile force to that part of said workpiece which passes through said first straightening device; a second straightening device disposed downstream of said second rolling mill for straightening said workpiece; means for applying a fourth tensile force to that part of said workpiece which passes through said second straightening device; and means for applying a fifth tensile force to that part of said workpiece which is positioned between said first rolling mill and said first straightening device.

A cold rolling system according to the invention comprises a first rolling mill providing a first rolling reduction and comprising first non-powered turks-head rolls and first powered turks-head rolls; a second rolling mill providing a second rolling reduction which is larger than said first rolling reduction, and comprising second non-powered turks-head rolls and second powered turks-head rolls, said second rolling mill being disposed opposite said first rolling mill; means for applying a first tensile force to that part of a workpiece which passes through said first rolling mill; means for applying a first tensile force to that part of said workpiece which passes through said second rolling mill; means for applying a second tensile force to that part of said workpiece which has passed through said first rolling mill and which is to be fed to said second rolling mill; means for applying a third tensile force to that part of said workpiece which has passed through said second rolling mill; a first straightening device disposed upstream of said first rolling mill for straightening said workpiece; means for applying a fourth tensile force to that part of said workpiece which passes through said first straightening device; a second straightening device disposed downstream of said second rolling mill for straightening said workpiece; means for applying a fourth tensile force to that part of said workpiece which passes through said second straightening device; means for applying a fifth tensile force to that part of said workpiece which is positioned between said first rolling mill and said first straightening device; a cutting device, positioned downstream of said second straightening device and running at a speed which is the same as the line speed of said workpiece, for cutting said workpiece into a desired length; and means for applying a sixth tensile force to that part of said workpiece which passes through said cutting device.

A cold rolling system according to the invention comprises a first rolling mill providing a first rolling reduction and comprising first non-powered turks-head rolls and first powered turks-head rolls; a second rolling mill providing a second rolling reduction which is larger than said first rolling reduction, and comprising second non-powered turks-head rolls and second powered turks-head rolls, said second rolling mill being disposed opposite said first rolling mill; means for applying a first tensile force to that part of a workpiece which passes through said first rolling mill; means for applying a first tensile force to that part of said workpiece which passes through said second rolling mill; means for applying a second tensile force to that part of said workpiece which has passed through said first rolling mill and which is to be fed to said second rolling mill; means for applying a third tensile force to that part of said workpiece which has passed through said second rolling mill; a first straightening device disposed upstream of said first rolling mill for straightening said workpiece; means for applying a fourth tensile force to that part of said workpiece which passes through said first straightening device; a second straightening device disposed downstream of said second rolling mill for straightening said workpiece; means for applying a fourth tensile force to that part of said workpiece which passes through said second straightening device; means for applying a fifth tensile force to that part of said workpiece which is positioned between said first rolling mill and said first straightening device; a heat-treatment device for heat-treating that part of said workpiece which has passed through said second straightening device; means for applying a seventh tensile force to that part of said workpiece which passes through said heat treatment device; a cutting device, positioned downstream of said second straightening device and running at a speed which is the same as the line speed, for cutting said workpiece into a desired length; and means for applying a sixth tensile force to that part of said workpiece which passes through said cutting device.

The first tensile force is determined by an area reduction rate of free rolls of said non-powered turks-head rolls according to the drawing force of driving rolls of said powered turks-head roll, the second tensile force is determined by a rotation ratio of driving rolls of said powered turks-head rolls, the third tensile force is determined by a rotation ratio between said driving rolls of said powered turks-head roll and feed pinch rollers provided between said driving rolls of said powered turks-head roll and said straightening device, the forth tensile force is determined by a rotation ratio of feed pinch rolls disposed upstream and downstream of said straightening device, the fifth tensile force is determined by a rotation ratio between said driving rolls of said first powered turks-head roll and vertical and lateral levelers constituting said straightening device, the sixth tensile force is determined by a rotation ratio of feed pinch rollers disposed upstream and downstream of said cutting device, the seventh tensile force is determined by a rotation ratio of feed pinch rollers disposed upstream and downstream of said heat treatment device.

The second, third, fourth and fifth tensile forces An and the first tensile force Bn satisfy the following conditions:

$$1 \leqq An \leqq \sigma_B/2 \text{ (kg/mm}^2\text{)}$$

$$1 \leqq Bn \leqq \sigma_B/2 \text{ (kg/mm}^2\text{)}$$

$$(An+Bn) < \{(\text{Drawing force caused by rolling torque of } Rn)+(A_{n+})\}$$

wherein $\sigma_B$ is the tensile strength of said workpiece, and Rn represents the corresponding powered turks-head roll.

The drawing force of Rn is determined by the draft of Rn, said draft of Rn being in the range of 5 to 30%, and wherein Rn has an area reduction rate of 5 to 30%, and rn has an area reduction rate in the range of 1 to 10%, where Rn and rn represent the corresponding powered turks-head roll and non-powered turks-head roll, respectively.

The cold rolling system further comprises a dancer roll disposed between said first and second rolling mills.

Each of the straightening devices has levelers for applying repeated bending in vertical and lateral directions to said workpiece to which a tensile force is being applied. In the cold rolling system ,the workpiece is a coil material having a circular or square cross-section suitable for continuous processing.

A cold rolling method for cold rolling a workpiece according to the invention comprises a step of applying to a workpiece a first tensile force determined by an area reduction rate of free rolls of non-powered turks-head rolls according to the drawing force of powered turks-head rolls; a step of applying to said workpiece a second tensile force determined by a rotation ratio of driving rolls of said powered turks-head rolls; and a step of applying to said workpiece a third tensile force determined by a ration ratio between said driving rolls of said powered turks-head rolls and feed pinch rolls disposed upstream of a second straightening device.

A cold rolling method for performing straightening, cold rolling and straightening of a workpiece in succession according to the invention comprises a step of applying to a workpiece a first tensile force determined by an area reduction rate of free rolls of non-powered turks-head rolls according to a drawing force of powered turks-head rolls; a step of applying to said workpiece a second tensile force determined by a rotation ratio of driving rolls of said powered turks-head roll; a step of applying to said workpiece a third tensile force determined by a ration ratio between said driving rolls of said powered turks-head rolls and feed pinch rolls disposed upstream of a second straightening device, a step of applying to said workpiece a fourth tensile force determined by a rotation ratio between lateral and vertical levelers constituting a straightening device and feed pinch rolls disposed upstream and downstream of said levelers; and a step of applying to said workpiece a fifth tensile force determined by a rotation ratio between said driving rolls of said first powered turks-head rolls and said vertical and lateral levelers constituting said straightening device.

A cold rolling method for performing straightening, cold rolling, straightening and cutting of a workpiece in succession according to the invention comprises a step of applying to a workpiece a first tensile force determined by an area reduction rate of free rolls of non-powered turks-head rolls according to a drawing force of powered turks-head rolls; a step of applying to said workpiece a second tensile force determined by a rotation ratio of driving rolls of said powered turks-head rolls; a step of applying to said workpiece a third tensile force determined by a ration ratio between said driving rolls of said powered turks-head rolls and feed pinch rolls disposed upstream of said second straightening device; a step of applying to said workpiece a fourth tensile force determined by a rotation ratio between lateral and vertical levelers constituting a straightening device and feed pinch rolls disposed upstream and downstream of said levelers; a step of applying to said workpiece a fifth tensile force determined by a rotation ratio between said driving rolls of said first powered turks-head rolls and said vertical and lateral levelers constituting said straightening device; and a step of applying to said workpiece a sixth tensile force determined by a rotation ratio of feed pinch rollers disposed upstream and downstream of a cutting device.

A cold rolling method for performing straightening, cold rolling, straightening, heat-treatment and cutting of a workpiece in succession according to the invention comprises a step of applying to a workpiece a first tensile force determined by an area reduction rate of free rolls of non-powered turks-head rolls according to a drawing force of powered turks-head rolls; a step of applying to said workpiece a second tensile force determined by a rotation ratio of driving rolls of said powered turks-head roll; a step of applying to said workpiece a third tensile force determined by a ration ratio between said driving rolls of said powered turks-head rolls and feed pinch rolls disposed upstream of a second straightening device; a step of applying to said workpiece a fourth tensile force determined by a rotation ratio between lateral and vertical levelers constituting a straightening device to feed pinch rolls disposed upstream of and downstream of said levelers; a step of applying to said workpiece a fifth tensile force determined by a rotation ratio between said driving rolls of said first powered turks-head rolls and vertical and lateral levelers constituting a straightening device; a step of applying to said workpiece a seventh tensile force determined by a rotation ratio of feed pinch rollers disposed upstream and downstream of a heat treatment device disposed downstream of said straightening device; and a step of applying to said workpiece a sixth tensile force determined by a rotation ratio of feed pinch rollers disposed upstream and downstream of a cutting device after said heat treatment.

A cold rolling method for performing a series of processes according to the invention comprises rolling and cutting of a workpiece in succession, wherein tensile forces are applied to said workpiece during processes from said rolling to straightening.

The second, third, fourth and fifth tensile forces An and said tensile force Bn satisfy the following conditions:

$$1 \leqq An \leqq \sigma_B/2 \text{ (kg/mm}^2\text{)}$$

$$1 \leqq Bn \leqq \sigma_B/2 \text{ (kg/mm}^2\text{)}$$

$$An+Bn<\{(\text{Drawing force caused by rolling torque of } Rn)+(A_{n+1})\}$$

wherein $\sigma_B$ is a tensile strength of the workpiece, wherein said drawing force of Rn is determined by the draft of Rn, said draft of Rn being in the range of 5 to 30%, wherein Rn has an area reduction rate in the range of 5 to 30%, and rn has an area reduction rate in the range of 1 to 10%, and wherein Rn and rn represent powered turks-head rolls and non-powered turks-head rolls, respectively.

The first tensile force is 2~15 (kg/mm$^2$), preferably 5~10 (kg/mm$^2$), the second tensile force is 5~50 (kg/mm$^2$), preferably 15~25 (kg/mm$^2$), the third tensile force is 5~20 (kg/mm$^2$), preferably 10~15 (kg/mm$^2$),and the fifth tensile forces is 2~15 (kg/mm$^2$), preferably 5~10 (kg/mm$^2$).

DETAILED DESCRIPTION OF THE PREFERRED EMBODIMENTS

Description will be hereinafter made of one embodiment of a cold rolling system and a cold rolling method according to the present invention in detail with reference to the accompanying FIGS.

Figure 1:
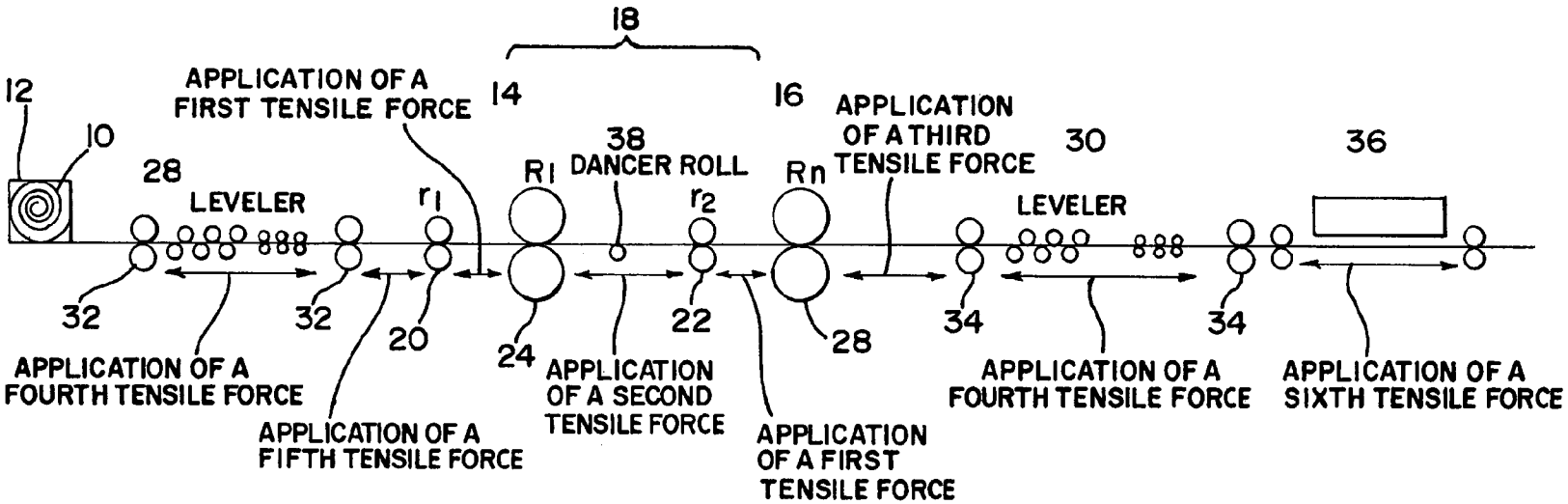
FIG. 1 is a schematic view illustrating a cold rolling system according to the present invention.
Figure 2:
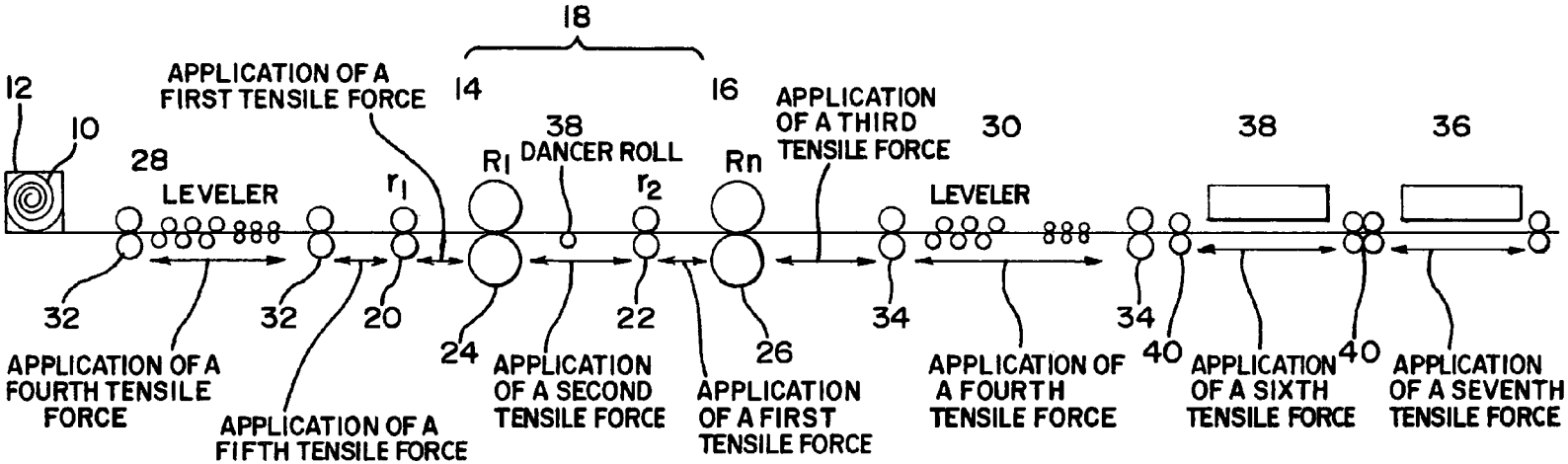
FIG. 2 is a schematic view illustrating another cold rolling system according to the present invention.

FIG. 1 is a schematic view of a tandem cold rolling mill constituting the cold rolling system. A workpiece 10, which has been wound into a coil, is mounted on an unwinder 12. The workpiece 10 is a wire rod of a medium carbon steel, a case-hardened steel, a martensitic stainless steel, an austenitic stainless steel or the like having a circular or square cross-section and is usually to be formed into a final product having a cross-sectional area of 100 to 800 mm$^2$.

As viewed in FIG. 1, the workpiece 10 is moved from left to right on a rolling line formed along this direction. The cold rolling system has a rolling mill group 18 which includes a first rolling mill 14 having a first rolling reduction, and a second rolling mill 16 having a second rolling reduction which is larger than the first rolling reduction and disposed opposite the first rolling mill 14. The rolling mill group 18 may also include a plurality of rolling mills disposed between the first and second rolling mills 14 and 16.

The first rolling mill 14 has first non-powered turks-head rolls 20 and first powered turks-head rolls 24. The second rolling mill 16 has first non-powered turks-head rolls 22 and second powered turks-head rolls 26. The first and second roll mills 14 and 16 constitute a tandem rolling structure. The non-powered turks-head rolls 20 and 22 each comprise four, upper, lower, right and left free rolls, while the powered turks-head rolls 24 and 26 each comprise a pair of upper and lower driving rolls and a pair of right and left free rolls. The driving rolls are inverter-or servo-controlled. Preferably, the rolls of the rolling mills 14 and 16 are configured to be easily exchanged to rolls of different diameters so that the cold rolling system may be adapted for rolling small-quantity, large-variety workpieces.

A tensile force (first tensile force) determined by an area reduction rate of the free rolls of the first non-powered turks-head rolls 20 according to the drawing force of the driving rolls of the first powered turks-head rolls 24 is applied to that part of the workpiece 10 which passes through the first rolling mill 14. Similarly, a tensile force (first tensile force) determined by an area reduction rate of the free rolls of the second non-powered turks-head rolls 22 according to the drawing force of the driving rolls of the second powered turks-head rolls 26 is applied to that part of the workpiece 10 which passes through the second rolling mill 16. Namely, the first tensile force is applied to the workpiece 10 in accordance with the area reduction rate of the non-powered turks-head rolls when it is drawn by the driving rolls of the powered turks-head rolls of the rolling mill.

A tensile force (second tensile force) is applied to that part of the workpiece 10 which has passed through the first rolling mills 14. Namely, the second tensile force is applied to that part of the workpiece 10 which is positioned downstream of the first powered turks-head rolls 24 but upstream of the second rolling mill 16. The second tensile force is determined by a rotation ratio of the paired driving rolls of the first powered turks-head rolls 24. A tensile force (third tensile force) is applied to that part of the workpiece 10 which has passed through the second rolling mill 16. Namely, the third tensile force is applied to that part of the workpiece 10 which is positioned downstream of the second powered turks-head rolls 26. The third tensile force is determined by a rotation ratio between the second powered turks-head roll 26 and hereinafter described feed pinch rollers 34.

The rolling line is also provided with a first straightening device 28 located upstream of the first rolling mill 14 and with a second straightening device 30 located downstream of the second rolling mill 16. The straightening devices 28 and 30 each comprise a vertical leveler and a lateral leveler. A pair of feed pinch rollers 32 are provided upstream and downstream of the first straightening device 28, while a pair of feed pinch rollers 34 are provided upstream and downstream of the second straightening device 30. A tensile force (forth tensile force) is applied to that part of the workpiece 10 which passes through each of the straightening devices 28 and 32. The fourth tensile force is determined by the rotation ratio between the vertical and lateral levelers constituting the straightening device and the feed pinch rollers disposed upstream of and downstream of the levelers. The workpiece 10 is subjected to repeated bending-in a vertical direction under the tensile force during its passage through the vertical leveler and is subjected to repeated bending in a lateral direction under the tensile force during its passage through the lateral leveler. Thereby, the bends of the workpiece 10 in lateral and vertical directions thereof are removed to form a straightened workpiece.

That part of the workpiece 10 which has passed through the second straightening device 30 is cut into a desired length by a cutting device 36. The cutting device 36 may be a running cutter which runs at a speed which is the same as the line speed. When the workpiece 10 is cut at a high speed, a tensile force (sixth tensile force) is preferably applied thereto. However, when the workpiece 10 must be cut with a high dimensional accuracy or with smooth cut surfaces, it is desired not to apply the sixth tensile force thereto.

It is preferred the second, third, fourth and fifth tensile forces An and the first tensile force Bn meet with the following conditions:

$$1 \leqq An \leqq \sigma_B/2 \text{ (kg/mm}^2\text{)}$$

$$1 \leqq Bn \leqq \sigma_B/2 \text{ (kg/mm}^2\text{)}$$

$$(An+Bn) < \{(\text{Drawing force caused by rolling torque of } Rn)+(A_{n+1})\}$$

wherein $\sigma_B$ is the tensile strength of the workpiece, and Rn represents the corresponding powered turks-head roll.

The first tensile force is 2~15 (kg/mm$^2$), preferably 5~10 (kg/mm$^2$), the second tensile force is 5~50 (kg/mm$^2$), preferably 15~25 (kg/mm$^2$), the third tensile force is 5~20 (kg/mm$^2$),preferably 10~15 (kg/mm$^2$), and the fifth tensile forces is 2~15 (kg/mm$^2$), preferably 5~10 (kg/mm$^2$) Wherein the second tensile force is higher than any other of the first, the third or the fifth tensile force. The third and fifth tensile force are lower than the second tensile force.

The drawing force created by Rn is determined by the draft of Rn. The draft of Rn is 5 to 30%. Rn has an area reduction rate in the range of 5 to 30%, and rn has an area reduction rate in the range of 1 to 10%, wherein Rn and rn represent the corresponding powered turks-head roll and non-powered turks-head roll, respectively.

Between the first and second rolling mills 14 and 16 is preferably provided a dancer roll 38. The dancer roll, which enables a tensile force to be set at a desirable value and controlled with ease, can be suitably used as the means for applying the second tensile force upstream of the final rolling mill where dimensional accuracy of the workpiece is especially important. If desired, it is possible to remove the non-powered turks-head roll 20 of the first rolling mill 14 and to allow a shot-blast device or the levelers constituting the first straightening device 28 provided upstream of the first rolling mill 14 to serve the function of the non-powered turks-head roll 20.

According to the cold rolling method with the above cold rolling system, the workpiece receives (a) the first tensile force determined by the area reduction rate of the free rolls of the non-powered turks-head roll according to the drawing force of the powered turks-head rolls, (b) the second tensile force determined by the rotation ratio of the driving rolls of the powered turks-head roll, (c) the third tensile force determined by the rotation ratio between the driving rolls of the powered turks-head rolls and the feed pinch rolls located between the powered turks-head rolls and the straightening device, (d) the fourth tensile force determined by the rotation ratio between the vertical and lateral levelers constituting the straightening device and the feed pinch rollers provided upstream and downstream of the levelers, (e) the fifth tensile force determined by the rotation ratio between the driving rolls of the first powered turks-head roll and the vertical and lateral levelers constituting the straightening device, and (f) the sixth tensile force determined by the rotation ratio of the feed pinch rollers provided upstream and downstream of the cutting device.

As described above, when the workpiece is cut at a high speed, a tensile force (sixth tensile force) may be applied thereto. In the case, however, where the material must be cut with a high dimensional accuracy or fine cut surfaces, it is preferred not to apply the sixth tensile force to the workpiece. When the material must be cut with high dimensional accuracy or with smooth cut surfaces, a disk-type metal slitting saw or a carbide chip saw may be used. When the cutting is conducted at a high speed with increased line speed, a cam type or hydraulic shearing device may be used.

Thus, the workpiece receives tensile forces successively during its passage through the first straightening device, first and second rolling mills, second straightening device and being cut by the cutting device. This permits reduction of the roll force of the rolling mills and stable insertion of the workpiece between the rolls, improving dimensional stability of the workpiece. Also, the straightness of the workpiece can be improved as a result of the straightening, and a relatively uniform plastic strain can be applied to the workpiece. This reduces remaining stress in the workpiece after rolling and thus reduces dimensional changes of the workpiece in quenching or machining afterwards.

Description will be hereinafter made of another embodiment of a cold milling system and a cold milling method according to the present invention in detail with reference to an accompanying drawing.

The cold rolling system comprises, as in the case with the above embodiment, an unwinder 12 of which the workpiece is wound out, a first straightening device 28, a first rolling mill 14 having a first rolling reduction, a second rolling mill 16 having a second rolling reduction which is larger than the first rolling reduction and disposed opposite the first rolling mill 14, a second straightening device 30, and a cutting device 36 for cutting the workpiece. As described above, the workpiece receives tensile forces successively during passing through the first straightening device 28, the first and second rolling mills 14 and 16, the second straightening device and being cut by the cutting device 36.

The cold rolling system has a heat treatment unit 38 for heat-treating that part of the workpiece which has passed through the straightening device 30 and which is to be cut by the cutting device 36. A tensile force determined by the rotation ratio of feed pinch roller 40 provided upstream and downstream of the heat treatment unit 38. Thus, the workpiece is heat treated under the tensile force during its passage through the heat treatment unit 38. The heat treatment unit 38 may be a quenching device which is easy to control electrically, such as a high-frequency heating and cooling device or a laser heating device. By suitably controlling the rotation ratio of the feed pinch rollers 40 upstream and downstream of the heat treatment unit 38, the workpiece 10 can be subjected to heat treatment under a desirable tensile force. This improves the straightness of the workpiece.

The cold milling system and the cold milling method according to the above two embodiments of the present invention is suitable for producing a special member such as a special rail and a special shaft.

According to the cold rolling system and cold rolling method of the present invention, a rapture of a workpiece due to plastic deformation under triaxial compression, which is a feature of cold rolling can be prevented. Also, mutual sliding between rolls of a very small diameter and the workpiece is utilized to eliminate the processes of annealing, pickling and chemical conversion coating and accomplish cost reduction and energy saving. Additionally, material loss can be reduced to 5% or lower. Moreover, dimensional variation among workpieces can be decreased (within 0.05 mm or lower) and straightness of the rolled workpiece including end parts thereof after cutting can be improved (final precision of 0.1 mm). Furthermore, lead time necessary to process a base material before it is introduced into the rolling line can be considerably decreased, resulting in reduction of running and equipment costs.

INDUSTRIAL APPLICABILITY

The invention is applicable to a cold rolling system having a tandem structure comprising a plurality of rolling mills each having a powered turks-head roll having driving rolls vertically disposed and free rolls laterally disposed and a non-powered turks-head roll. It is also applicable to a cold rolling method using the above system. Further, the cold rolling system and method of the invention are suitable for producing a special member such as a special rail and a special shaft.

What is claimed is:

1. A cold rolling system comprising:

a first rolling mill providing a first rolling reduction and comprising first non-powered turks-head rolls and first powered turks-head rolls;

a second rolling mill providing a second rolling reduction which is larger than said first rolling reduction, and comprising second non-powered turks-head rolls and second powered turks-head rolls, said second rolling mill being disposed opposite said first rolling mill;

means for applying a first tensile force to that part of a workpiece which passes through said first rolling mill;

means for applying a first tensile force to that part of said workpiece which passes through said second rolling mill;

means for applying a second tensile force to that part of said workpiece which has passed through said first rolling mill and which is to be fed to said second-rolling mill;

means for applying a third tensile force to that part of said workpiece which has passed through said second rolling mill;

a first straightening device disposed upstream of said first rolling mill for straightening said workpiece;

means for applying a fourth tensile force to that part of said workpiece which passes through said first straightening device;

a second straightening device disposed downstream of said second rolling mill for straightening said workpiece;

means for applying a fourth tensile force to that part of said workpiece which passes through said second straightening device;

means for applying a fifth tensile force to that part of said workpiece which is positioned between said first rolling mill and said first straightening device;

a cutting device, positioned downstream of said second straightening device and running at a speed which is the same as a line speed of said workpiece, for cutting said workpiece into a desired length; and means for applying a sixth tensile force to that part of said workpiece which passes through said cutting device.

2. A cold rolling system as claimed in claim 1, wherein said first tensile force is determined by an area reduction rate of free rolls of said non-powered turks-head rolls according to a drawing force of driving rolls of said powered turks-head roll, wherein said second tensile force is determined by a rotation ratio of driving rolls of said powered turks-head rolls, wherein said third tensile force is determined by a rotation ratio between said driving rolls of said powered turks-head roll and feed pinch rollers provided between said driving rolls of said powered turks-head roll and said straightening device, wherein said forth tensile force is determined by a rotation ratio of feed pinch rolls disposed upstream and downstream of said straightening device, wherein said fifth tensile force is determined by a rotation ratio between said driving rolls of said first powered turks-head roll and vertical and lateral levelers constituting said straightening device, and wherein said sixth tensile force is determined by a rotation ratio of feed pinch rollers disposed upstream and downstream of said cutting device.

3. A cold rolling system as claimed in claim 2, wherein said second, third, fourth and fifth tensile forces An and said first tensile force Bn satisfy the following conditions:

$$1 \leqq An \leqq \sigma_B/2 \text{ (kg/mm}^2\text{)}$$

$$1 \leqq Bn \leqq \sigma_B/2 \text{ (kg/mm}^2\text{)}$$

$$(An+Bn) < \{(\text{Drawing force caused by rolling torque of } Rn)+(A_{n+1})\}$$

wherein $\sigma_B$ is a tensile strength of said workpiece, and Rn represents the corresponding powered turks-head roll.

4. A cold rolling system as claimed in claim 3, wherein said drawing force of Rn is determined by a draft of Rn, said draft of Rn being in the range of 5 to 30%, and wherein Rn has an area reduction rate of 5 to 30%, and rn has an area reduction rate in the range of 1 to 10%, where Rn and m represent the corresponding powered turks-head roll and non-powered turks-head roll, respectively.

5. A cold rolling system as claimed in claim 1, further comprising a dancer roll disposed between said first and second rolling mills.

6. A cold rolling system as claimed in claim 1, wherein each of said straightening devices has levelers for applying repeated bending in vertical and lateral directions to said workpiece to which a tensile force is being applied.

7. A cold rolling system as claimed in claim 1, wherein said workpiece is a coil material having a circular or square cross-section suitable for continuous processing.

8. A cold rolling method for performing straightening, cold rolling, straightening and cutting of a workpiece in succession, comprising:

a step of applying to a workpiece a first tensile force determined by an area reduction rate of free rolls of non-powered turks-head rolls according to a drawing force of powered turks-head rolls;

a step of applying to said workpiece a second tensile force determined by a rotation ratio of driving rolls of said powered turks-head rolls;

a step of applying to said workpiece a third tensile force determined by a rotation ratio between said driving rolls of said powered turks-head rolls and feed pinch rolls disposed upstream of a second straightening device;

a step of applying to said workpiece a fourth tensile force determined by a rotation ratio between lateral and vertical levelers constituting a straightening device and feed pinch rolls disposed upstream and downstream of said levelers;

a step of applying to said workpiece a fifth tensile force determined by a rotation ratio between said driving rolls of said first powered turks-head rolls and said vertical and lateral levelers constituting said straightening device; and a step of applying to said workpiece a sixth tensile force determined by a rotation ratio of feed pinch rollers disposed upstream and downstream of a cutting device.

9. A cold rolling method as claimed in claim 8, wherein said second, third, fourth and fifth tensile forces An and said first tensile force Bn satisfy the following conditions:

$$1 \leqq An \leqq \sigma_B/2 \text{ (kg/mm}^2\text{)}$$

$$1 \leqq Bn \leqq \sigma_B/2 \text{ (kg/mm}^2\text{)}$$

$$An+Bn<\{(\text{Drawing force caused by rolling torque of } Rn)+(A_{n+1})\}$$

wherein $\sigma_B$ is a tensile strength of the workpiece, wherein a drawing force of Rn is determined by a draft of Rn, said draft of Rn being in the range of 5 to 30%, wherein Rn has an area reduction rate in the range of 5 to 30%, and m has an area reduction rate in the range of 1 to 10%, and wherein Rn and m represent powered turks-head rolls and non-powered turks-head rolls, respectively.

10. A cold rolling method as claimed in claim 8, wherein said first tensile force is 2~15 (kg/mm$^2$), preferably 5~10 (kg/mm$^2$), said second tensile force is 5~50 (kg/mm$^2$), preferably 15~25 (kg/mm$^2$), said third tensile force is 5~20 (kg/mm$^2$), preferably 10~15 (kg/mm$^2$), and said fifth tensile forces is 2~15 (kg/mm$^2$), preferably 5~10 (kg/mm$^2$).

* * * * *